US009698466B2

(12) United States Patent
Harper

(10) Patent No.: US 9,698,466 B2
(45) Date of Patent: Jul. 4, 2017

(54) RADIATING STRUCTURE FORMED AS A PART OF A METAL COMPUTING DEVICE CASE

(71) Applicant: Microsoft Technology Licensing, LLC, Redmond, WA (US)

(72) Inventor: Marc Harper, Issaquah, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 255 days.

(21) Appl. No.: 14/090,353

(22) Filed: Nov. 26, 2013

(65) Prior Publication Data

US 2014/0347225 A1 Nov. 27, 2014

Related U.S. Application Data

(60) Provisional application No. 61/827,372, filed on May 24, 2013, provisional application No. 61/827,421, filed on May 24, 2013.

(51) Int. Cl.
*H01Q 1/24* (2006.01)
*H01Q 1/50* (2006.01)
(Continued)

(52) U.S. Cl.
CPC ..... *H01Q 1/242* (2013.01); *H01Q 1/2266* (2013.01); *H01Q 1/50* (2013.01); *H01Q 5/328* (2015.01);
(Continued)

(58) Field of Classification Search
CPC ..... H01Q 1/2266; H01Q 1/242; H01Q 9/42; H01Q 5/328; H01Q 1/243; H01Q 5/371
(Continued)

(56) References Cited

U.S. PATENT DOCUMENTS 4,518,965 A 5/1985 Hidaka
4,625,212 A 11/1986 Oda et al.
(Continued)

FOREIGN PATENT DOCUMENTS

CN 102683861 A 9/2012
EP 2405534 A1 1/2012
(Continued)

OTHER PUBLICATIONS

"International Search Report & Written Opinion for PCT Patent Application No. PCT/US14/39426", Mailed Date: Sep. 10, 2014, 14 Pages.
(Continued)

*Primary Examiner* — Tho G Phan
(74) *Attorney, Agent, or Firm* — Holzer Patel Drennan

(57) ABSTRACT

A metal computing device case includes one or more metal side faces bounding at least a portion of the metal back face. The metal computing device case includes a radiating structure including an exterior metal surface of the metal computing device case. The metal computing device case substantially encloses electronics of a computing device. The exterior metal surface is a metal plate insulated from the rest of the metal computing device case by a dielectric insert filling slots between the metal plate and the rest of the metal computing device case. The radiating structure also includes a ceramic block spaced from a metal plate by a dielectric spacer. The metal plate is insulated from the rest of the metal computing device case and is capacitively coupled with the ceramic block.

20 Claims, 6 Drawing Sheets

(51) Int. Cl.

| | |
|---|---|
| ***H01Q 1/22*** | (2006.01) |
| ***H01Q 9/04*** | (2006.01) |
| ***H01Q 9/14*** | (2006.01) |
| ***H01Q 9/42*** | (2006.01) |
| ***H01Q 5/328*** | (2015.01) |
| ***H01Q 5/378*** | (2015.01) |

(52) U.S. Cl.
CPC ..... *H01Q 5/378* (2015.01); *H01Q 9/0485* (2013.01); *H01Q 9/145* (2013.01); *H01Q 9/42* (2013.01)

(58) Field of Classification Search
USPC ..... 343/700 MS, 702, 829, 846
See application file for complete search history.

(56) References Cited

U.S. PATENT DOCUMENTS

| | | | | |
|---|---|---|---|---|
| 6,339,400 | B1 | 1/2002 | Flint et al. | |
| 6,348,897 | B1 | 2/2002 | Alameh et al. | |
| 6,642,891 | B2 | 11/2003 | Baro | |
| 6,650,294 | B2 | 11/2003 | Ying et al. | |
| 7,084,814 | B2 | 8/2006 | Chen et al. | |
| 7,132,987 | B1 | 11/2006 | Olsson et al. | |
| 7,215,283 | B2 | 5/2007 | Boyle | |
| 7,321,337 | B2 | 1/2008 | Ikeda et al. | |
| 7,342,540 | B2 | 3/2008 | Nahar et al. | |
| 7,535,421 | B2 | 5/2009 | Tseng et al. | |
| 7,545,327 | B2 | 6/2009 | Iellici et al. | |
| 7,671,804 | B2 | 3/2010 | Zhang et al. | |
| 7,705,786 | B2 | 4/2010 | Iellici et al. | |
| 8,125,772 | B2 | 2/2012 | Kim | |
| 8,269,677 | B2 * | 9/2012 | Guterman | H01Q 1/2266 343/702 |
| 8,410,985 | B2 | 4/2013 | Mercer et al. | |
| 8,644,012 | B2 | 2/2014 | Lee | |
| 8,648,752 | B2 | 2/2014 | Ramachandran et al. | |
| 8,963,785 | B2 * | 2/2015 | Dong | H01Q 21/30 343/702 |
| 9,070,969 | B2 | 6/2015 | Mow et al. | |
| 9,196,952 | B2 * | 11/2015 | Tran | H01Q 1/243 |
| 9,197,270 | B2 * | 11/2015 | Ying | H04B 1/3827 |
| 9,287,612 | B2 * | 3/2016 | Bolin | H01Q 1/243 |
| 2003/0201945 | A1 | 10/2003 | Reece et al. | |
| 2004/0041734 | A1 | 3/2004 | Shiotsu et al. | |
| 2004/0222925 | A1 | 11/2004 | Fabrega-Sanchez et al. | |
| 2004/0257283 | A1 * | 12/2004 | Asano | H01Q 1/243 343/702 |
| 2005/0085204 | A1 | 4/2005 | Poilasne et al. | |
| 2005/0146475 | A1 * | 7/2005 | Bettner | G06F 1/1616 343/767 |
| 2006/0244663 | A1 | 11/2006 | Fleck et al. | |
| 2007/0120740 | A1 | 5/2007 | Iellici et al. | |
| 2007/0210969 | A1 | 9/2007 | Vance | |
| 2008/0316115 | A1 | 12/2008 | Hill et al. | |
| 2009/0153412 | A1 | 6/2009 | Chiang et al. | |
| 2010/0053002 | A1 | 3/2010 | Wojack et al. | |
| 2010/0214180 | A1 | 8/2010 | Krogerus | |
| 2010/0231481 | A1 | 9/2010 | Chiang et al. | |
| 2010/0321253 | A1 * | 12/2010 | Ayala Vazquez | H01Q 1/2258 343/702 |
| 2011/0136447 | A1 | 6/2011 | Pascolini et al. | |
| 2011/0241949 | A1 | 10/2011 | Nickel et al. | |
| 2012/0154223 | A1 | 6/2012 | Oh et al. | |
| 2012/0176280 | A1 | 7/2012 | Chen et al. | |
| 2012/0274522 | A1 | 11/2012 | Ayatollahi | |
| 2013/0021212 | A1 | 1/2013 | Lai et al. | |
| 2013/0082884 | A1 | 4/2013 | Gummalla | |
| 2013/0135150 | A1 | 5/2013 | Kenoun et al. | |
| 2013/0169486 | A1 | 7/2013 | Huang et al. | |
| 2013/0194138 | A1 * | 8/2013 | Hammond | H01Q 13/10 343/702 |
| 2014/0203974 | A1 * | 7/2014 | Liu | H01Q 1/2266 343/702 |
| 2014/0347226 | A1 | 11/2014 | Iellici et al. | |
| 2014/0347227 | A1 | 11/2014 | Iellici et al. | |

FOREIGN PATENT DOCUMENTS

| | | | |
|---|---|---|---|
| GB | 2409345 | A | 6/2005 |
| GB | 2410131 | A | 7/2005 |
| GB | 2476035 | A | 6/2011 |
| JP | 2007194995 | A | 8/2007 |
| WO | 2004/091046 | A1 | 10/2004 |
| WO | 2005091430 | | 9/2005 |
| WO | 2006134402 | | 12/2006 |
| WO | 2010025023 | A2 | 3/2010 |

OTHER PUBLICATIONS

"International Preliminary Report on Patentability" issued on PCT Application No. PCT/US2014/039416, mailed date: Aug. 3, 2015, 6 pages.

"International Preliminary Report on Patentability Issued in PCT Patent Application No. PCT/US2014/039421", Mailed Date: Sep. 4, 2015, 6 Pages.

Petosa, A. et al, "Dielectric Resonator Antennas: A Historical Review and the Current State of Art", Antennas and Propagation Magazine, IEEE, (vol. 52, Issue 5) Oct. 2010, pp. 91-116.

Lee, T.H. et al, "New Dielectric Resonator Antenna Design for Mobile Handsets", Mobile & Satellite Communications Research Center, University of Bradford, Bradford BD7 1DP, UK; www.researchgate.net/publication 228992335.

International Searching Authority, U.S. Patent and Trademark Office, Second Written Opinion for PCT/US2014/039426, mailed Apr. 14, 2015, 6 pages.

"International Search Report & Written opinion for PCT Patent Application No. PCT/US2014/039421", dated Aug. 22, 2014, 13 pages.

International Search Report and Written Opinion Received for Patent Application No. PCT/US2014/039416, mailed Sep. 19, 2014, 14 Pages.

International Searching Authority, U.S. Patent and Trademark Office, Second Written Opinion for PCT/US2014/039421, mailed Apr. 21, 2015, 8 pages.

International Preliminary Report on Patentability Issued in PCT Application No. PCT/US2014/039426, mailed Aug. 3, 2015, 7 pages.

"Non-Final Office Action", U.S. Appl. No. 14/090,465, Nov. 10, 2015, 6 pages.

"Non-Final Office Action", U.S. Appl. No. 14/090,542, Nov. 10, 2015, 6 pages.

Non-Final Office Action issued in U.S. Appl. No. 14/090,465, dated Mar. 28, 2016, 6 pages.

Non-Final Office Action issued in U.S. Appl. No. 14/090,542, dated May 17, 2016, 7 pages.

"First Office Action and Search Report Issued in Chinese Patent Application No. 201480029606.6", Mailed Date: Apr. 5, 2017, 12 Pages.

* cited by examiner

RADIATING STRUCTURE FORMED AS A PART OF A METAL COMPUTING DEVICE CASE

CROSS-REFERENCE TO RELATED APPLICATIONS

The present application claims benefit to U.S. Provisional Application No. 61/827,372, filed on May 24, 2013 and entitled "Back Face Antenna for a Computing Device Case," and U.S. Provisional Application No. 61/827,421, filed on May 24, 2013 and entitled "Side Face Antenna for a Computing Device Case," both of which are specifically incorporated by reference for all that they disclose and teach.

The present application is also related to U.S. application Ser. No. 14/090,465, filed concurrently herewith and entitled "Back Face Antenna in a Computing Device Case", and U.S. application Ser. No. 14/090,542, filed concurrently herewith and entitled Side Face Antenna for a Computing Device Case", both of which are specifically incorporated by reference for all that they disclose and teach.

BACKGROUND

Antennas for computing devices present challenges relating to receiving and transmitting radio waves at one or more select frequencies. These challenges are magnified by a current trend of housing such computing devices (and their antennas) in metal cases, as the metal cases tend to shield incoming and outgoing radio waves. Some attempted solutions to mitigate this shielding problem introduce structural and manufacturing challenges into the design of the computing device.

SUMMARY

Implementations described and claimed herein address the foregoing problems by forming an antenna assembly from a portion of the metal computing device case as a primary radiating structure. A metal computing device case includes one or more metal side faces bounding at least a portion of the metal back face. The metal computing device case includes a radiating structure including an exterior metal surface of the metal computing device case. The metal computing device case substantially encloses electronics of a computing device. The exterior metal surface is a metal plate insulated from the rest of the metal computing device case by a dielectric insert filling slots between the metal plate and the rest of the metal computing device case. The radiating structure also includes a ceramic block spaced from a metal plate by a dielectric spacer. The metal plate is insulated from the rest of the metal computing device case and is capacitively coupled with the ceramic block.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

DETAILED DESCRIPTION

Figure 1:
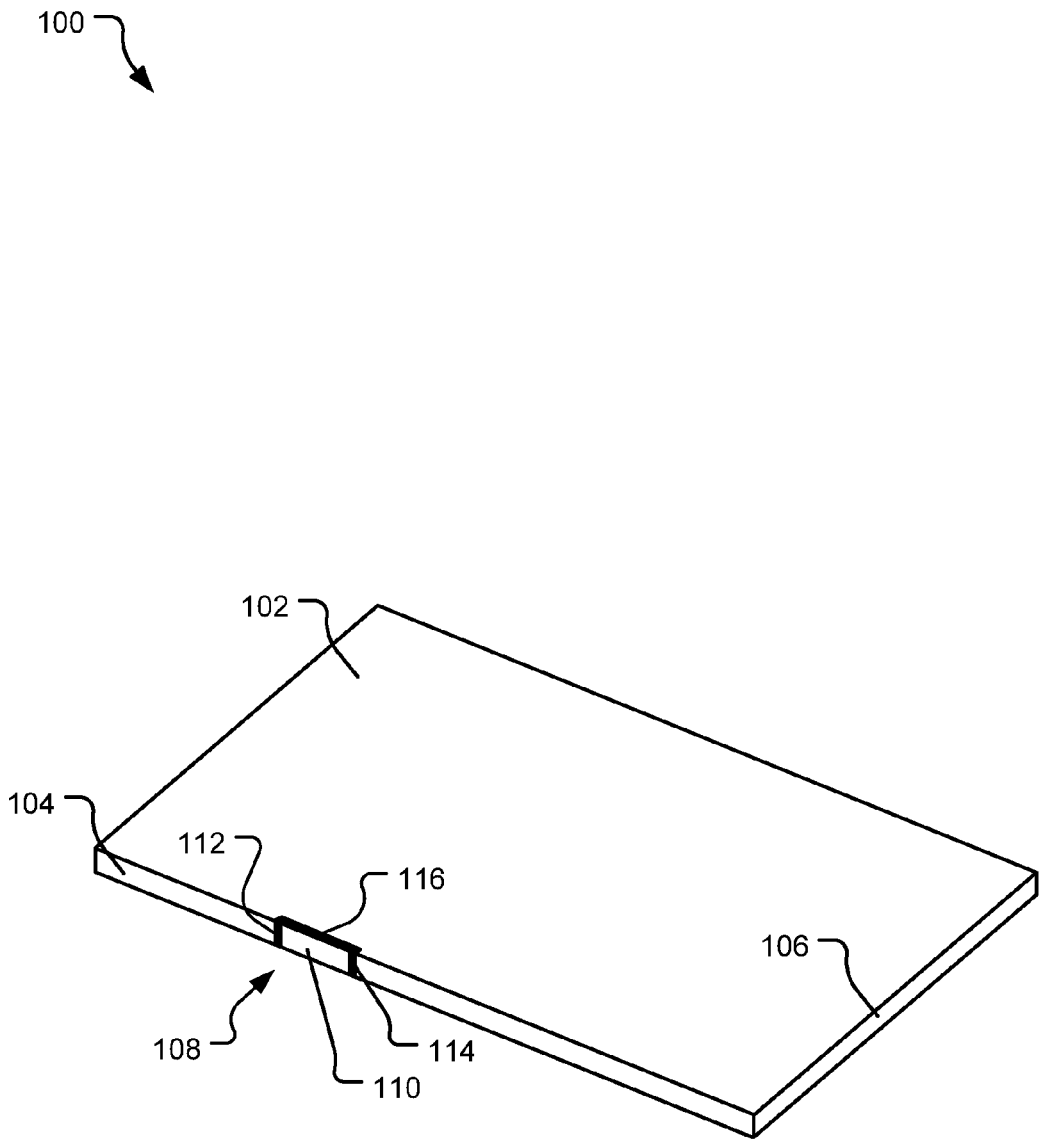
FIG. 1 illustrates a metal back face and two metal side faces of an example metal computing device case having an antenna structure having an antenna structure that includes a part of the metal computing device case.

FIG. 1 illustrates a metal back face 102 and two metal side faces 104 and 106 of an example metal computing device case 100 having an antenna structure 108 that includes a part of the metal computing device case 100. As illustrated, the antenna structure 108 includes metal plate 110 (e.g., part of the metal side face 104 of the metal computing device case 100 or another metal plate) separated from the metal side face 104 and the metal back face 102 by three cut-out slots 112, 114, and 116. It should be understood that the metal plate 110 may alternatively be formed as a part of the back face 102 of the metal computing device case 100. The exterior surface of the metal plate 110 is exposed (e.g., the surface of the metal plate 110 is exposed to a user's environment, touchable by a user, etc.), and the interior surface of the metal plate 110 is coupled to a feed structure (not shown) within the interior of the metal computing device. It should be understood that multiple such antenna structures may be formed in the metal back face 102 or any metal side face of the metal computing device case 100.

The metal back face 102 and various metal side faces generally form a back section of the metal computing device case 100 in which electronic and mechanical components of the computing device are located. A front face (not shown) typically includes a display surface, such as a touch screen display. The front face is assembled to the back section of the metal computing device case 100 to enclose the electronic components of the computing device, including at least one processor, tangible storage (e.g., memory, magnetic storage disk), display electronics, communication electronics, etc.

In one implementation, the antenna structure 108 is located at an exterior surface of the metal computing device case 100, such that an exposed portion of the metal computing device case 100 (e.g., metal plate 110) that performs as a part of a radiating structure for operation of the antenna structure 108. The metal plate 110 and the rest of the side face 104 may act as a radiating structure. In other implementations, the antenna structure 108 may include a metal plate 110 that is not a portion of the metal computing device case 100 but is a separate metal plate (possibly of a different metallic or composite composition) forming, in combination with the metal side face 104, a back section of the enclosed metal computing device case 100. Such a radiating structure may be designed to resonate at a particular frequency, and/or, for certain applications, may be designed to radiate very limited, or substantially zero, power at a particular frequency or set of frequencies.

The cut-out slots 112, 114, and 116 are filled by a dielectric material (e.g., plastic), providing insulation between the metal plate 110 and the metal side face 104 and the metal back face 102 and closing gaps in the metal computing device case 100. In some implementations, the insert may have a voltage-dependent dielectric constant. The metal plate 110 is also insulated from contact with the front face of the computing device. Although not shown, the four edge of the metal plate 110 may also be insulated from the metal computing device case 100, such as by a fourth edge of dielectric material, an insulating gasket, contact with a glass layer in the front section of the computing device, etc. The separation of the metal plate 110 from the rest of the metal computing device case 100 and the exterior exposure of the metal plate 110 provides low coupling to other antennas within the metal computing device case 100 and to the metal computing device 100 itself.

The metal computing device case 100 is shown with abrupt corners between the metal side faces 104, 106 and the metal back face 102. In other implementations, fewer than four sides may partially bound the metal back face 102. In addition, the metal back face 102 and one or more of the metal side faces may be joined at an abrupt corner, at a curved corner (e.g., a continuous arc between the metal back face and the metal side face), or in various continuous intersecting surface combinations. Furthermore, the metal side faces need not be perpendicular to the metal back face (e.g., a metal side face may be positioned at an obtuse or acute angle with the metal back face). In one implementation, the metal back face and one or more metal side faces are integrated into a single piece construction, although other assembled configurations are also contemplated.

In one implementation, the width of each slot 112, 114, and 116 is 2 mm, with the slots 112 and 114 being 8 mm long and the slot 116 being 29 mm. Nevertheless, it should be understood that other dimensions and configurations may be employed. The plastic insert in the slots and otherwise surrounding the metal plate 110 insulate or isolate the metal plate from the rest of the metal computing device case 100, which may be grounded.

Figure 2:
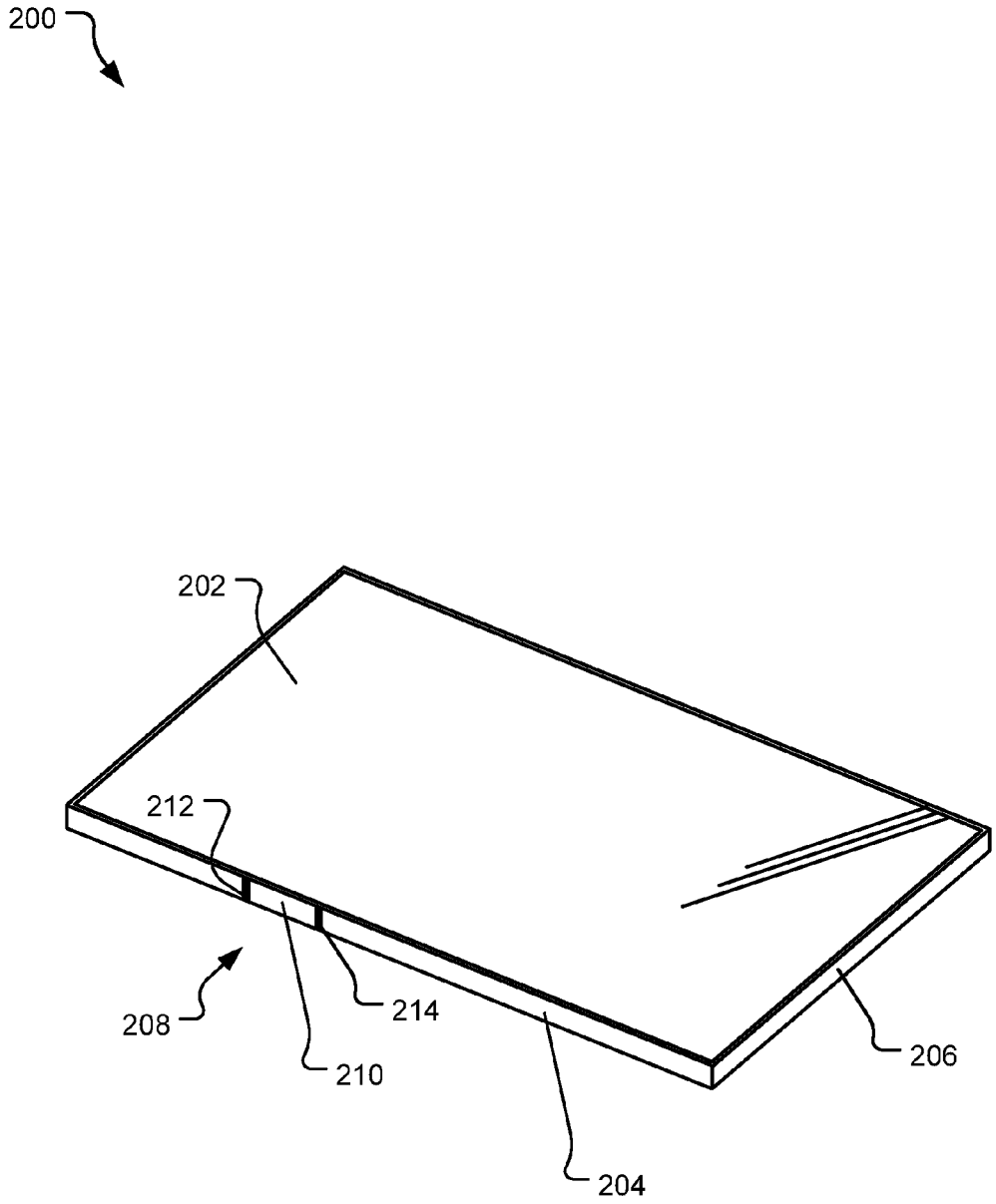
FIG. 2 illustrates a front face of a computing device and two metal side faces of an example metal computing device case having an antenna structure that includes a part of the metal computing device case.

FIG. 2 illustrates a front face 202 of a computing device 200 and two metal side faces 204 and 206 of an example metal computing device case having an antenna structure 208 that includes a part of the metal computing device case. In a typical implementation, the front face 202 represents a display surface, including possibly a touch screen display surface. Electronic and mechanical components of computing device 200 are typically located within a base section of the metal computing device case (e.g., surrounded by the metal side faces and a metal back face of the metal computing device case). The front face 202 is typically assembled to the back section to fully enclose the electronic and mechanical components of the computing device 200.

As illustrated, the antenna structure 208 includes metal plate 210 (e.g., part of the metal side face 204 of the metal computing device case or another metal plate) separated from the metal side face 204 and the metal back face by two cut-out side slots 212 and 214 and a back slot (not shown) between the metal plate 210 and the metal back face. The exterior surface of the metal plate 210 is exposed (e.g., the surface of the metal plate 210 is exposed to a user's environment, touchable by a user, etc.), and the interior surface of the metal plate 210 is coupled to a feed structure (not shown) within the interior of the computing device 200. It should be understood that multiple such antenna structures may be formed in the metal back face 202 or any metal side face of the metal computing device case.

In one implementation, the antenna structure 208 is located at an exterior surface of the metal computing device case, such that an exposed portion of the metal computing device case (e.g., metal plate 210) performs as a part of a radiating structure for operation of the antenna structure 208. In other implementations, the antenna structure 208 may include a metal plate 210 that is not a portion of the metal computing device case but is a separate metal plate (possibly of a different metallic or composite composition) forming, in combination with the metal side face 204, the enclosed metal computing device case.

The cut-out slots 212, 214, and the back slot are filled by a dielectric material (e.g., plastic), providing insulation between the metal plate 210 and the metal side face 204 and the metal back face and closing gaps in the metal computing device case. In some implementations, the insert may have a voltage-dependent dielectric constant. The metal plate 210 is also insulated from contact with the front face of the computing device 200. It should be understood that, although not shown, the four edge of the metal plate 210 is also insulated from the metal computing device case, such as by a fourth edge of dielectric material, an insulating gasket, contact with a glass layer in the front section of the computing device 200, etc.

As described with regard to FIG. 1, the intersections of metal side faces, the metal back face and the front face may provide many different configurations, including abrupt junctions, continuous junctions, curved faces, etc.

Figure 3:
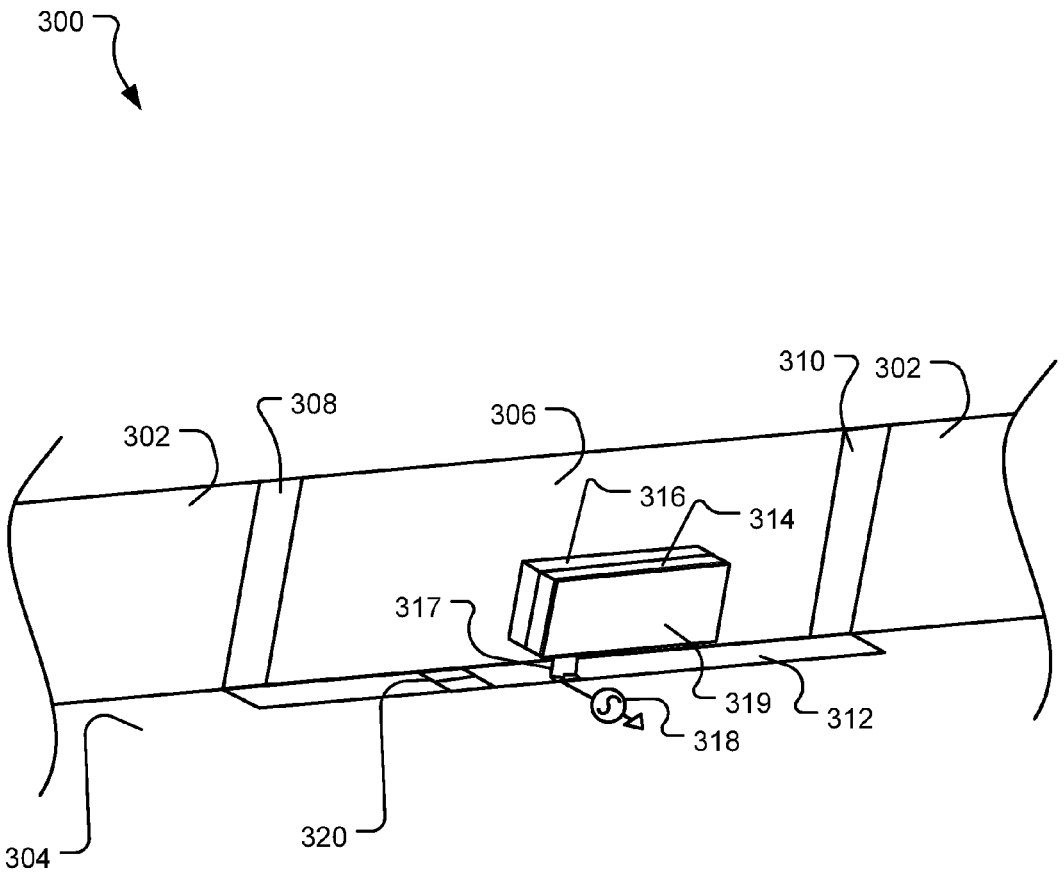
FIG. 3 illustrates an example antenna structure that includes a part of the metal computing device case.

FIG. 3 illustrates an example antenna structure 300 that includes a part of the metal computing device case, including a metal side face 302, a metal back face 304, and a metal plate 306. Accordingly, the metal plate 306 forms an exterior metal surface of the metal computing device case. The slots 308, 310, and 312 electrically insulate the metal plate 306 from the metal side face 302 and the metal back face 304. The slots 308, 310, and 312 are filled by a dielectric material (e.g., plastic), providing insulation between the metal plate 306 and the metal side face 302 and between the metal plate 306 and the metal back face 304 and closing gaps in the metal computing device case. In some implementations, the insert may have a voltage-dependent dielectric constant.

A high dielectric constant ceramic block 314 is capacitively coupled across a dielectric spacer 316 and fed by a feed structure 317 that is electrically connected between a radio 318 and a metallized surface 319 on the ceramic block 314. The ceramic block 314 may operate as the only radiating structure or may operate as an active antenna in combination with the metal plate 306 and the rest of the surrounding metal computing device case acting as a parasitic antenna.

The metal plate 306 is connected to the ground plane of the metal back face 304 via a series and/or parallel resonant circuit 320 (e.g., including an inductor and/or a capacitor). The resonant circuit 320 allows for multi-band operation. For example, with the use of a high band or low pass filter, it is possible to enable multiple resonant frequencies during operation. In another example, the ceramic block 314 is the resonant structure and the resonant circuit 320 is configured as an open circuit at the frequency of the ceramic antenna. When the resonant circuit 320 is short-circuited, the metal plate 306 is driven by the capacitance of the dielectric material.

The ceramic block 314 provides a dielectric resonant antenna as a feed mechanism to excite the metal plate 306. In this configuration, the dielectric resonant antenna provides most of the near-field of the resonant frequency contained within the ceramic block 314, which improves immunity to hand effects and low coupling to other antennas within the contained system. Furthermore, the exposure of the metal plate 306 to the exterior of the metal computing device case reduces coupling to the metal computing device case itself and thereby increases efficiency of the antenna structure 300. An implementation providing a series resonant circuit 320 may be used to implement a dual-band antenna design.

Figure 4:
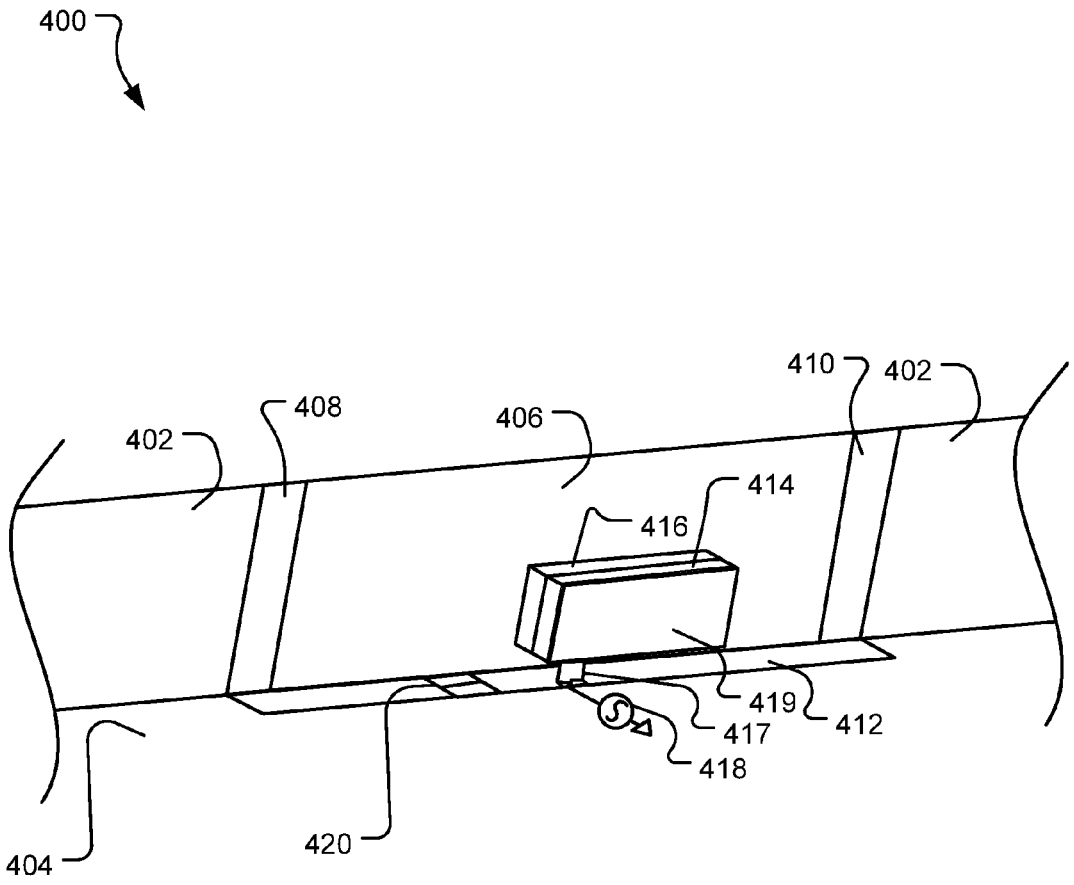
FIG. 4 illustrates another example antenna structure that includes a part of the metal computing device case.

FIG. 4 illustrates another example antenna structure 400 that includes a part of the metal computing device case, including a metal side face 402, a metal back face 404, and a metal plate 406. Accordingly, the metal plate 406 forms an exterior metal surface of the metal computing device case. The slots 408, 410, and 412 electrically insulate the metal plate 406 from the metal side face 402 and the metal back face 404. The slots 408, 410, and 412 are filled by a dielectric material (e.g., plastic), providing insulation between the metal plate 406 and the metal side face 402 and between the metal plate 406 and the metal back face 404 and closing gaps in the metal computing device case. In some implementations, the insert may have a voltage-dependent dielectric constant.

A high dielectric constant ceramic block 414 is capacitively coupled across a dielectric spacer 416 and fed by a feed structure 417 that is electrically connected between a radio 418 and a metallized surface 419 on the ceramic block 414. The ceramic block 414 can operate as the only radiating structure or can operate as an active antenna in combination with the metal plate 406 and the rest of the surrounding metal computing device case acting as a parasitic antenna.

The metal plate 406 is connected to the ground plane of the metal back face 404 via a series inductor circuit 420. The series inductor circuit 420 allows inductive loading of the antenna, such that the antenna's operating frequency can be lowered without increasing the antenna size. The ceramic block 414 provides a dielectric resonant antenna as a feed mechanism to excite the metal plate 406. In this configuration, the dielectric resonant antenna provides most of the near-field of the resonant frequency contained within the ceramic block 414, which improves immunity to hand effects and low coupling to other antennas within the contained system. Furthermore, the exposure of the metal plate 406 to the exterior of the metal computing device case reduces coupling to the metal computing device case itself and thereby increases efficiency of the antenna structure 400. An implementation providing a series inductor circuit 420 may be used to implement a single-band antenna design for use in Global Positioning System (GPS) communications and Global Navigation Satellite System (GLONASS) communications. The use of the series inductor circuit 420 may also allow the slots 408, 410, and 412 to be thinner than in other configurations. The series inductor circuit 420 can also load the antenna with additional inductance, allowing the metal plate to be smaller for a given operational frequency or allowing a larger metal plate to operate at a lower frequency.

Various implementations of an antenna structure described herein include configuration having a capacitive feed/resonant dielectric antenna that excites an external metallic feature of the metal computing device case. The use of the dielectric resonant antenna as the feed mechanism provides that most of the near-field of the resonant frequency of the dielectric antenna is contained within the ceramic block, thereby increasing immunity to hand effects, providing lower coupling to other antennas within the contained system, and reducing shielding effects of the metal computing device case itself. The described configurations may further reduce the amount of interior space occupied by the antenna structure, particularly at higher resonant frequencies.

Figure 5:
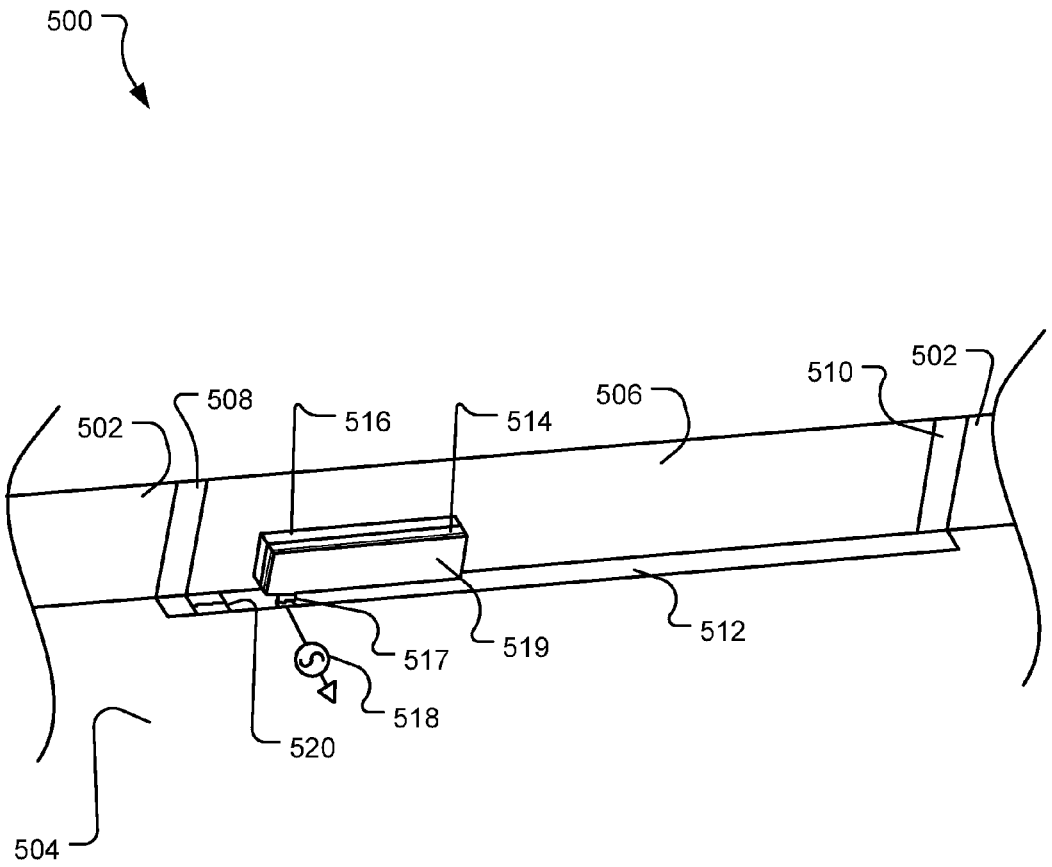
FIG. 5 illustrates yet another example antenna structure that includes a part of the metal computing device case, including a metal side face, a metal back face, and a metal plate.

FIG. 5 illustrates yet another example antenna structure that includes a part of the metal computing device case, including a metal side face 502, a metal back face 504, and a metal plate 506. The metal plate 506 forms an exterior metal surface of the metal computing device case. The slots 508, 510, and 512 electrically insulate the metal plate 506 from the metal side face 502 and the metal back face 504. The slots 508, 510, and 512 are filled by a dielectric material (e.g., plastic), providing insulation between the metal plate 506 and the metal side face 502 and between the metal plate 506 and the metal back face 504 and closing gaps in the metal computing device case. In some implementations, the insert may have a voltage-dependent dielectric constant.

A high dielectric constant ceramic block 514 is capacitively coupled across a dielectric spacer 516 and fed by a feed structure 517 that is electrically connected between a radio 518 and a metallized surface 519 on the ceramic block 514. The ceramic block 514 can operate as the only radiating structure or can operate as an active antenna in combination with the metal plate 506 and the rest of the surrounding metal computing device case acting as a parasitic antenna.

The metal plate 506 is connected to the ground plane of the metal back face 504 via a switched inductor circuit 520. As with the single inductor described with regard to FIG. 4, the switched inductor circuit 520 allows a lower operational frequency for a given metal plate 506; however, multiple inductance valuates provided by the switched inductor circuit 520 provide for a selection among multiple operational frequencies and therefore a broader range of multi-band frequency operation.

The ceramic block 514 provides a dielectric resonant antenna as a feed mechanism to excite the metal plate 506. In this configuration, the dielectric resonant antenna provides most of the near-field of the resonant frequency contained within the ceramic block 514, which improves immunity to hand effects and low coupling to other antennas within the contained system. Furthermore, the exposure of the metal plate 506 to the exterior of the metal computing device case reduces coupling to the metal computing device case itself and thereby increases efficiency of the antenna structure 500. Such example configurations may include addition of a switched inductor between the metal plate and the ground plane for low band resonant tuning and/or an automatic impedance matching circuit.

Figure 6:
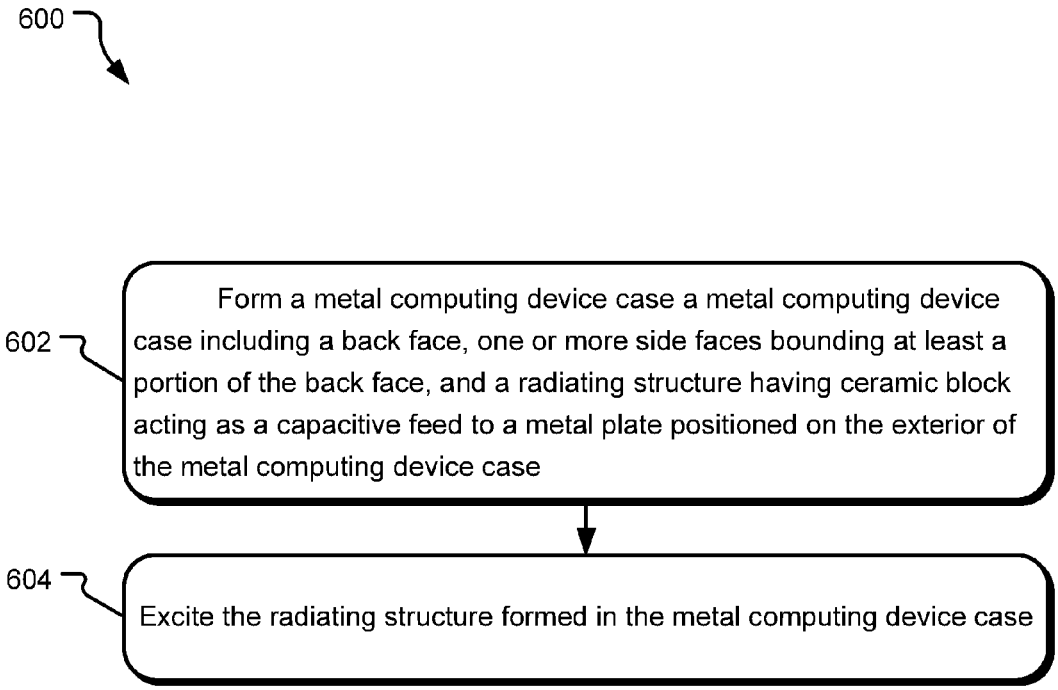
FIG. 6 illustrates example operations for using an antenna structure formed in a metal computing device case.

FIG. 6 illustrates example operations 600 for using a structure formed in a metal computing device case. A forming operation 602 provides a metal computing device case including a metal back face and one or more metal side faces bounding at least a portion of the metal back face. The metal computing device case further includes a radiating structure having ceramic block acting as a capacitive feed to a metal plate positioned on the exterior of the metal computing device case, such as in a metal side face or metal back face. A circuit (e.g., a series or parallel resonant circuit, a series inductor circuit, a switched inductor circuit, etc.) coupled the metal plate to the ground plane of the metal computing device case.

An exciting operation 604 excites the radiating structure in the metal computing device case causing the radiating structure to resonate at one or more resonance frequencies over time. In many configurations, the radiating structure provides excellent omnidirectional radiation performance.

It should also be understood that combinations of side faces and/or the back faces might form part of the radiating structure. For example, in one implementation, the metal plate is positioned in a cut-out in the back face, such that the back face and the metal plate form part of the radiating structure. In other implementations, the metal plate is positioned in such a way that one or more side faces and the back face form part of the radiating structure.

The above specification, examples, and data provide a complete description of the structure and use of exemplary implementations. Since many implementations can be made without departing from the spirit and scope of the claimed invention, the claims hereinafter appended define the invention. Furthermore, structural features of the different examples may be combined in yet another implementation without departing from the recited claims.

What is claimed is:

1. A metal computing device case including one or more metal side faces bounding at least a portion of the metal back face, the metal computing device case comprising:

a radiating structure including an exterior metal surface of the metal computing device case, the metal computing device case substantially enclosing electronics of a computing device, the exterior metal surface including a metal plate insulated from a rest of the metal computing device case, the radiating structure further comprising a ceramic block spaced from the metal plate by a dielectric spacer.

2. The metal computing device case of claim 1, wherein the metal plate is insulated from the rest of the metal computing device case by a dielectric insert filling slots between the metal plate and the rest of the metal computing device case.

3. The metal computing device case of claim 2, wherein the dielectric insert includes a dielectric material having a voltage-dependent dielectric constant.

4. The metal computing device case of claim 1, wherein the metal plate is insulated from the rest of the metal computing device case and is capacitively coupled with the ceramic block.

5. The metal computing device case of claim 1, wherein the radiating structure is configured to be fed by a radio to excite the metal plate via capacitive coupling with the ceramic block.

6. The metal computing device case of claim 1, wherein the metal plate is connected to a ground plane of the metal computing device by a series resonant circuit.

7. The metal computing device case of claim 6, wherein the series resonant circuit provides a dual-band antenna design.

8. The metal computing device case of claim 1, wherein the metal plate is connected to a ground plane of the metal computing device by a parallel resonant circuit.

9. The metal computing device case of claim 1, wherein the metal plate is connected to a ground plane of the metal computing device by a series inductor circuit.

10. The metal computing device case of claim 9, wherein the series inductor circuit provides a single-band antenna design.

11. The metal computing device case of claim 1, wherein the metal plate is connected to a ground plane of the metal computing device by a switched inductor circuit.

12. The metal computing device case of claim 11, wherein the switched inductor circuit provides low band resonance tuning.

13. The metal computing device case of claim 11, wherein the switched inductor circuit provides automatic impedance matching.

14. A method comprising:

capacitively coupling a radiating structure to an external metal plate of a metal computing device case, the metal computing device case including a metal back face and one or more metal side faces bounding at least a portion of the metal back face and enclosing electronics of a computing device, the radiating structure including ceramic block acting as a capacitive feed to the external metal plate.

15. The method of claim 14, further comprising:

exciting the radiating structure via a feed structure connected to a radio circuit.

16. The method of claim 14, further comprising:

connecting the external metal plate to a ground plane of the metal computing device by a series resonant circuit.

17. The method of claim 14, further comprising:

connecting the external metal plate to a ground plane of the metal computing device by a series inductor circuit.

18. The method of claim 14, further comprising:

connecting the external metal plate to a ground plane of the metal computing device by a switched inductor circuit.

19. The method of claim 14, wherein the exterior metal surface is a metal plate insulated from a rest of the metal computing device case.

20. A method comprising:

exciting a radiating structure having a ceramic block acting as a capacitive feed to a metal plate positioned on an exterior surface of a metal computing device case, the ceramic block spaced away from the metal plate by dielectric spacer, excitation energy being provided by a radio connected to the ceramic block.

* * * * *